US006551145B2

(12) United States Patent
Kurimoto et al.

(10) Patent No.: US 6,551,145 B2
(45) Date of Patent: Apr. 22, 2003

(54) CONNECTOR

(75) Inventors: Naoya Kurimoto, Yokkaichi (JP); Kazuhiko Nimura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/014,368

(22) Filed: Dec. 14, 2001

(65) Prior Publication Data

US 2002/0076992 A1 Jun. 20, 2002

(30) Foreign Application Priority Data

Dec. 19, 2000 (JP) ..... 2000-385614
Dec. 19, 2000 (JP) ..... 2000-385623

(51) Int. Cl.[7] ..... H01R 13/514
(52) U.S. Cl. ..... 439/752; 439/595
(58) Field of Search ..... 439/752, 752.5, 439/595

(56) References Cited

U.S. PATENT DOCUMENTS 5,002,504 A * 3/1991 Carlson ..... 439/752
5,197,898 A 3/1993 Nagamine ..... 439/752
5,322,457 A * 6/1994 Tsuli et al. ..... 439/752
5,397,249 A * 3/1995 Endo et al. ..... 439/752
5,458,511 A * 10/1995 Sasai et al. ..... 439/752
5,607,327 A * 3/1997 Tsuji et al. ..... 439/752
6,036,552 A * 3/2000 Atsumi ..... 439/752
6,089,927 A * 7/2000 Seko et al. ..... 439/752
6,159,047 A * 12/2000 Tanaka ..... 439/752
6,386,916 B1 * 5/2002 Tachi et al. ..... 439/752

FOREIGN PATENT DOCUMENTS

JP 5326066 12/1993
JP 6176815 6/1994

* cited by examiner

*Primary Examiner*—P. Austin Bradley
*Assistant Examiner*—Briggitte Hammond
(74) *Attorney, Agent, or Firm*—Greenblum & Bernstein, P.L.C.

(57) ABSTRACT

A retainer inserted from one side face of a housing is equipped with projections which penetrate from the side of hooked grooves of female terminal fittings, and insert portions which penetrate into bending spaces of lances from the side. When female terminal fittings are partially inserted into chambers of the housing, the insert portions of the retainer contact against the side faces of lances which are bent into the bending spaces, and the projections contact against the side face of connecting parts of the female terminal fittings. Further movement of the retainer is prevented and the partial insertion is detected. When the retainer is properly inserted, the projections are fit on the hooked grooves to be directly locked, and the insert portions are inserted in the bending spaces to prevent bending of the lances to be indirectly locked. Therefore, the female terminal fittings are triply and strongly locked, including the hooking of the barb parts of the terminal fittings by the lances. Thus, the reliability of detection of partial insertion of terminal fittings is increased.

16 Claims, 8 Drawing Sheets

CONNECTOR

BACKGROUND OF THE INVENTION

1. Field of the Invention

The present invention relates to a connector provided with a retainer which detects partial insertion of terminal fittings and can lock fully inserted terminal fittings in a no-slip condition.

2. Description of Related Art

A side retainer type connector has been known which is configured to stop slipping of terminal fittings therein by inserting a retainer from the side face of terminal chambers and hooking projections provided on the retainer into holes notched on the side walls of terminal fittings. When terminal fittings are in a partially inserted condition in the chambers, the projections contact portions of the terminal fitting side walls which do not include the holes, therefore further insertion is blocked and the partial insertion condition is detected.

However, in such a conventional connector, the material of the terminal fittings is thin, and the projections occasionally bend the side walls of the terminal fittings to insert a retainer even when terminal fittings are not fully inserted. There has been a problem that the detection of partial insertion may not be reliable in this circumstance.

The connector described in Japanese Patent Publication (Kokai) HEI No. 5-326066 has also been conventionally known. This is a front retainer type connector, and includes a retainer having an insert portion which can be inserted into the bending space of a lance from the front face of a chamber. When terminal fittings are in a partially inserted condition in a chamber, the lance is still bent into the bending space, and therefore further insertion is blocked because the insertion portion is brought into contact with the bent lance when the retainer is inserted. On the other hand, when the terminal fittings are fully inserted in a proper position, the lance is restored to its original position and hooked in the terminal fittings. When the retainer is inserted, the insert portions penetrate into the bending spaces, and prevent further bending of the lances. The terminal fittings are thus doubly locked in a non-removal condition.

However, in such a conventional connector, when terminal fittings are in a partially inserted condition and the insert portion of a retainer is brought in contact with a bent lance in a bending space, an area which is brought into contact with the lance is small because it is inserted in from the front. Therefore, an insert portion may be forced in past the end of a bent lance. There has been a problem that the detection of partial insertion may not be reliable in this circumstance.

The present invention was developed to address the above-mentioned problems, and a purpose is to enhance the detection of partial insertion of terminal fittings.

SUMMARY OF THE INVENTION

In order to address the problems described above, a connector of the present invention for accommodating terminal fittings having locking grooves and barb portions is provided which includes a connector housing and a retainer. The connector housing includes chambers configured to receive terminal fittings inserted therein. Lances which protrude into the chambers are configured to bend into bending spaces outward of the chambers during insertion of terminal fittings, and to hook on barb portions of terminal fittings fully inserted in the chambers. Retainer insertion holes are formed on a side face of the connector housing for receiving the retainer laterally inserted therein in a direction transverse to the chambers.

The retainer includes hooking projections configured to penetrate into locking grooves of terminal fittings fully inserted in the chambers. The retainer also includes insert portions configured to penetrate into bending spaces of the lances to prevent bending thereof.

Further, in the connector according to the present invention partial insertion of a terminal fitting is detected when lateral movement of the retainer is prevented by a hooking projection contacting a side portion of a terminal fitting and an insert portion contacting a side portion of a lance.

The retainer may further include a front stop plate configured to cover front openings of the chambers and having terminal insertion openings through which tabs of male terminal fittings can be inserted.

Further, the retainer may be locked in a temporary locking position in which the hooking projections are laterally offset from the chambers and the insert portions are laterally offset from the bending spaces, to allow for insertion and extraction of the terminal fittings. The retainer may also be locked in a final locking position in which hooking projections are inserted into the chambers and the insert portions are inserted into the bending spaces, to prevent insertion and extraction of the terminal fittings.

In another aspect of the present invention, a connector for accommodating terminal fittings having barb portions is provided which includes a connector housing and a retainer. The connector housing includes chambers configured to receive terminal fittings inserted therein. Lances which protrude into the chambers are configured to bend into bending spaces outward of the chambers during insertion of terminal fittings, and to hook on barb portions of terminal fittings fully inserted in the chambers. Retainer insertion holes are formed on a side face of the connector housing for receiving the retainer laterally inserted therein in a direction transverse to the chambers. The retainer includes insert portions configured to penetrate into bending spaces of the lances to prevent bending thereof.

Further, in the connector according to the present invention partial insertion of a terminal fitting is detected when lateral movement of the retainer is prevented by an insert portion contacting a side portion of a lance.

The retainer may further include a front stop plate configured to cover front openings of the chambers and having terminal insertion openings through which tabs of male terminal fittings can be inserted.

Further, the retainer may be locked in a temporary locking position in which the insert portions are laterally offset from the bending spaces, to allow for insertion and extraction of the terminal fittings. The retainer may also be locked in a final locking position in which the insert portions are inserted into the bending spaces, to prevent insertion and extraction of the terminal fittings.

In another aspect of the present invention, a connector for accommodating a terminal fitting having a locking groove and a barb portion is provided which includes a connector housing and a retainer. The connector housing includes at least one chamber configured to receive a terminal fitting inserted therein. At least one lance which protrudes into the chamber, is configured to bend into a bending space outward of the chamber during insertion of a terminal fitting, and to hook on a barb portion of a terminal fitting fully inserted in the chamber. Retainer insertion holes are formed on a side face of the connector housing for receiving the retainer laterally inserted therein in a direction transverse to the chamber.

The retainer includes at least one hooking projection configured to penetrate into a locking groove of a terminal fitting fully inserted in the chamber. The retainer also includes at least one insert portion configured to penetrate into a bending space of the lance to prevent bending thereof.

Further, in the connector according to the present invention partial insertion of the terminal fitting is detected when lateral movement of the retainer is prevented by a hooking projection contacting a side portion of a terminal fitting and an insert portion contacting a side portion of a lance.

The retainer may further include a front stop plate configured to cover a front opening of the chamber and having a terminal insertion opening through which a tab of a male terminal fitting can be inserted.

Further, the retainer may be locked in a temporary locking position in which the hooking projection is laterally offset from the chamber and the insert portion is laterally offset from the bending space, to allow for insertion and extraction of the terminal fitting. The retainer may also be locked in a final locking position in which the hooking projection is inserted into the chamber and the insert portion is inserted into the bending space, to prevent insertion and extraction of the terminal fitting.

BRIEF DESCRIPTION OF THE DRAWINGS

The above and other objects, features and advantages of the present invention will be made apparent from the following description of the preferred embodiments, given as non-limiting examples, with reference to the accompanying drawings in which.

DETAILED DESCRIPTION OF THE PREFERRED EMBODIMENTS

The present invention is described below with reference to the embodiment shown in FIGS. 1–15.

Figure 11:
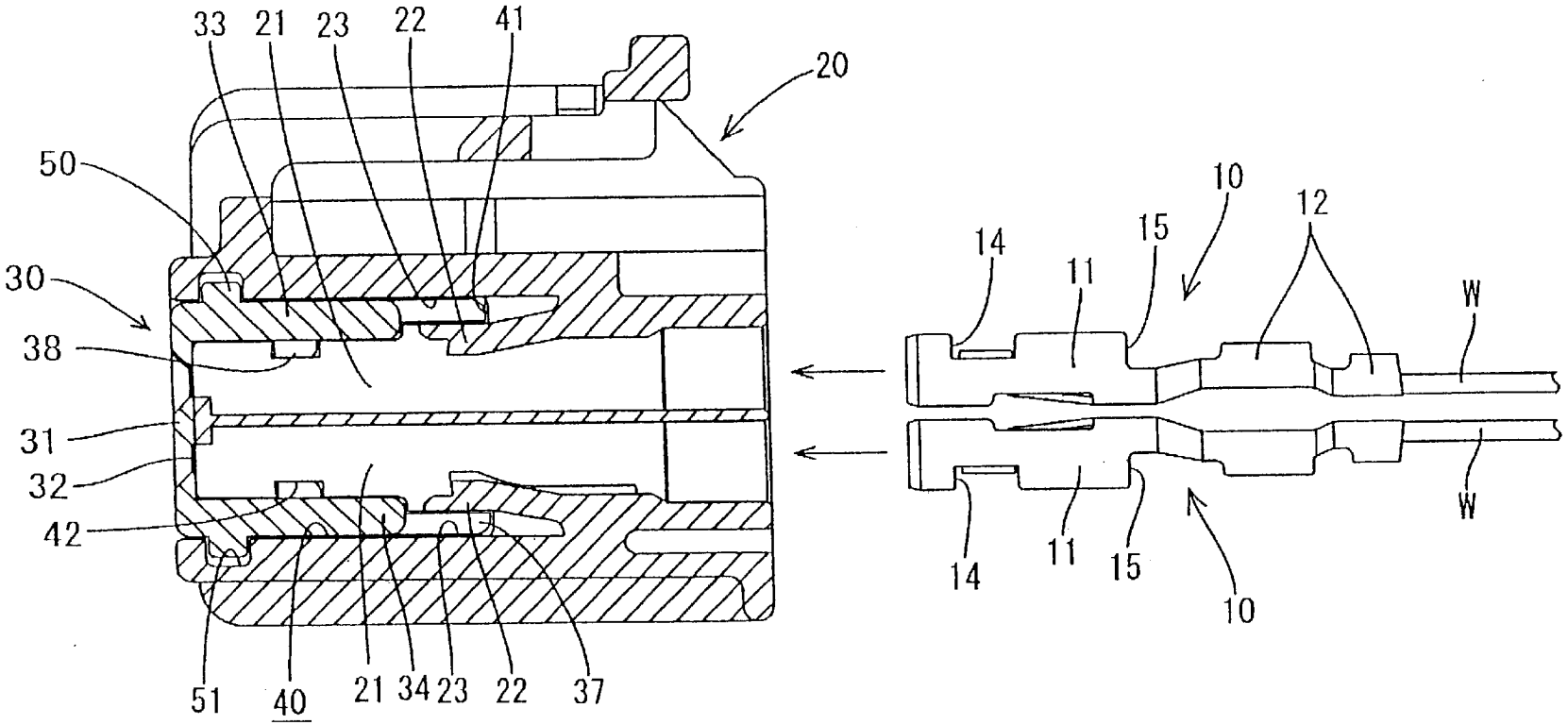
FIG. 11 is a sectional side view showing insertion of a female terminal fitting in a connector of the present invention.

As shown in FIG. 11, there is provided a female terminal connector housing 20, female terminal fittings 10 which are stored in the housing, and retainer 30 which detects partial insertion of female terminal fittings 10 and can lock them in a no-slip condition.

Female terminal fittings 10 have square tubular connecting portions 11 which receive therein tabs of corresponding male terminal fittings, and are fixed on the terminal ends of electric wires W by crimping barrels 12 which are provided at the rear thereof. Grooves 14, into which projections 38 of retainer 30 can be fitted, are formed on one face of the connecting parts 11 by being opened at the side face. Lances 22 of housing 20 can be hooked on the barb portions 15 of the rear rim of the same face.

The housing 20 may be formed of any suitable material, such as a synthetic resin, formed in a block form as shown in FIGS. 1–4. Chambers 21 store the female terminal fittings 10 and open on the front and rear faces of housing 20 in two levels which each contain five chambers. The chambers are symmetrically formed facing in opposite directions on the top and bottom levels. The lances 22 are respectively provided in a condition in which they can be elastically bent toward the upper face in the upper level of chambers 21, and toward the bottom face in the lower level of chambers 21, facing toward the bending spaces 23.

Accordingly, the female terminal fittings 10 are inserted within the chambers 21 from the rear (the right side of FIG. 11) while elastically bending the lances 22. When inserted to a proper position, the lances 22 are restored to their original position, and hooked on the barb portions 15. Lock arm 25 for locking with a male terminal fitting connector housing (not illustrated) is provided on the upper face of housing 20.

Figure 5:
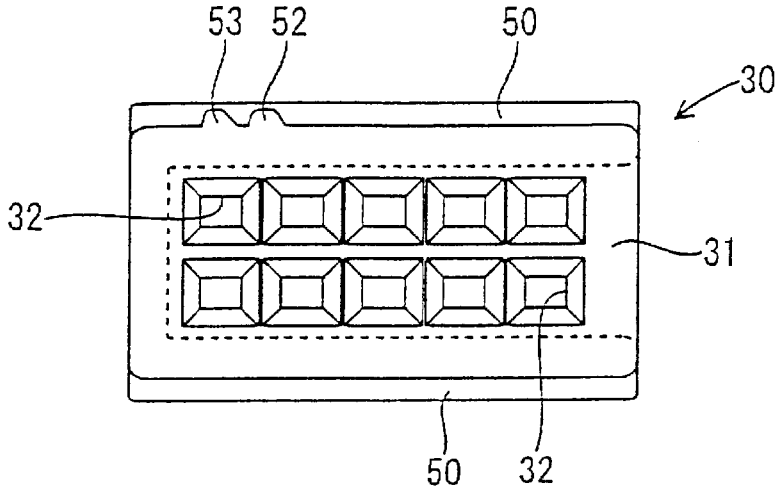
FIG. 5 is a front view of a retainer of the present invention.
Figure 6:
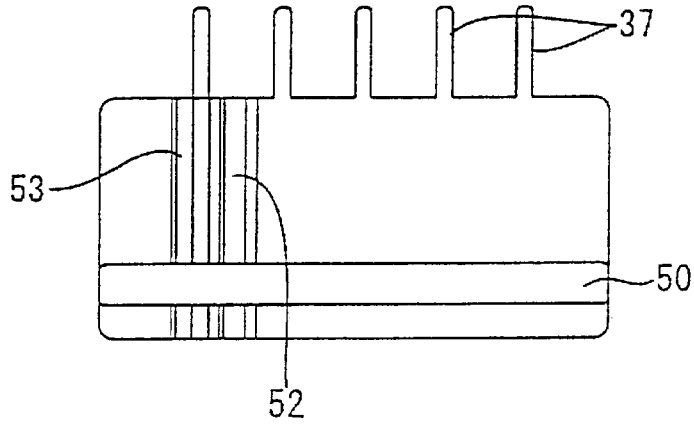
FIG. 6 is a plan view of the retainer of FIG. 5.
Figure 7:
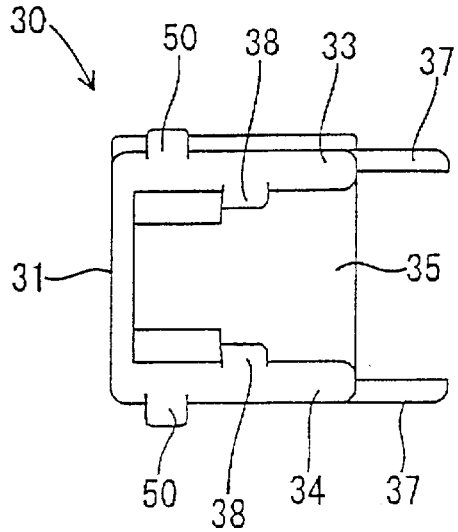
FIG. 7 is a side view of the retainer of FIG. 5.

The retainer 30 may be formed of any suitable material, such as with a synthetic resin material molded in a form as shown in FIGS. 5–7. The retainer 30 is provided with a front stop plate 31 which can be mounted to cover the front of the chambers 21 in housing 20. The front stop plate 31 functions to stop the female terminal fittings 20 inserted in the chambers 21 from extending out of the front ends of the chambers, while insertion openings 32 through which the tabs of the male terminal fittings may be inserted open at positions corresponding to the respective chambers 21.

A ceiling wall plate 33 and a bottom wall plate 34 respectively constitute the front end part of the ceiling wall of the upper level chambers 21 and the front end part of the bottom wall of the lower level chambers 21. They extend from upper and lower rims of the rear face of front stop plate 31. A side plate 35 is formed at one end of ceiling wall plate 33 and bottom wall plate 34. Slender insert portions 37 are formed at positions corresponding to the positions of insertion openings 32 and extend from rear edge rims of the ceiling wall plate 33 and the bottom wall plate 34. Hooking projections 38 are similarly formed at positions corresponding to the positions of insertion openings 32 at the midpoint of the inside face side of the ceiling wall plate 33 and the bottom wall plate 34. The respective projections 38 can penetrate into the hooked grooves 14 of the female terminal fittings 10 from the side.

Figure 3:
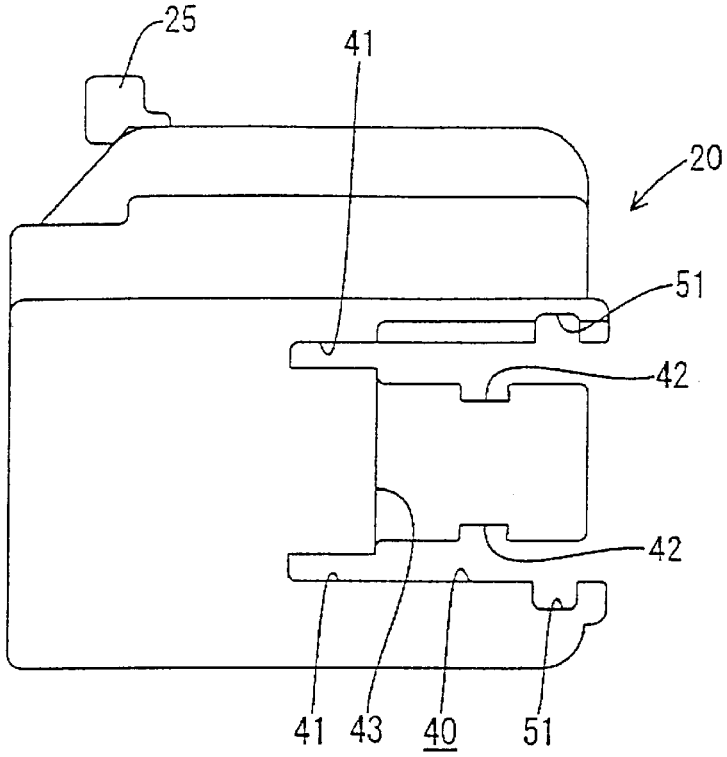
FIG. 3 is a side view of the housing of FIG. 1.
Figure 4:
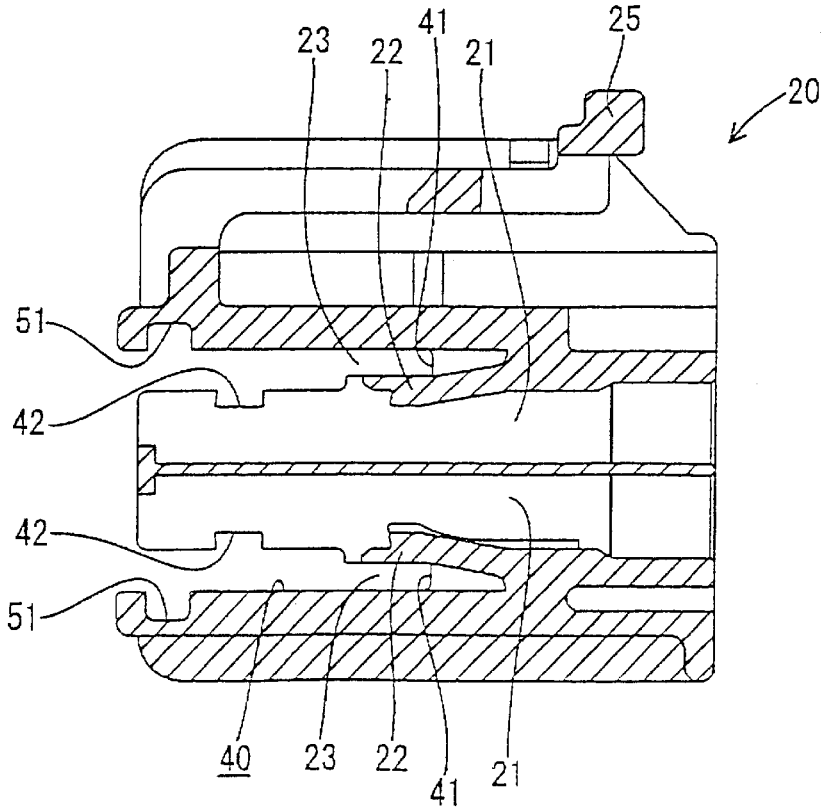
FIG. 4 is a sectional side view of the housing of FIG. 1.

Retainer insertion holes 40, in which the retainer 30 is inserted from the side, are formed in the side face of the housing 20, as shown in FIG. 3. They are formed as channels in which front stop plate 31, ceiling wall plate 33 and bottom wall plate 34 are received. Further, upper and lower insertion grooves 41 which receive insert portions 37 extend into bending spaces 23 of the lances. Projection insertion grooves 42 which receive projections 38 are formed in the lower face of the upper insertion hole 40 and in the upper face of the lower insertion hole 40. The respective projection insertion grooves 42 correspond to the configurations of the ceiling face of the upper level chambers 21 and the bottom face of the lower level chambers 21. Specifically, projection insertion grooves 42 are in positions corresponding to the hooked grooves 14 when the female terminal fittings 10 are properly inserted.

Further, concave parts 43 are formed on the side face of the insertion side of the retainer insertion holes 40 so that the side plate 35 of the retainer 30 is fitted therein in a condition coplanar with the side of housing 20.

Ribs 50 extending in the transverse direction are formed over the entire width of the respective outer faces of the ceiling wall plate 33 and the bottom wall plate 34 of the retainer 30. Guide grooves 51 which receive the ribs 50 extend in the transverse direction and are formed on the top face and the bottom face of the retainer insertion holes 40.

Figure 1:
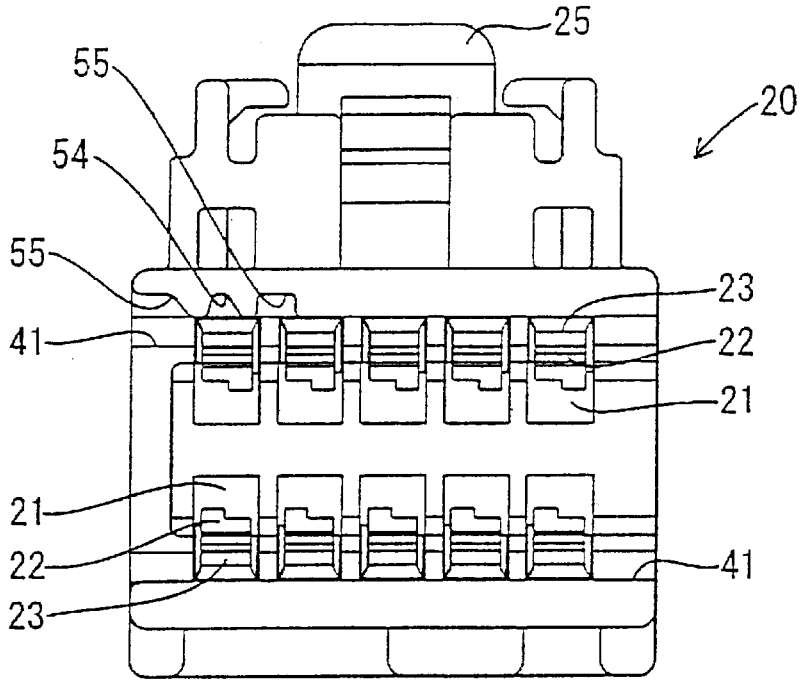
FIG. 1 is a front view of a female terminal housing of the present invention.
Figure 2:
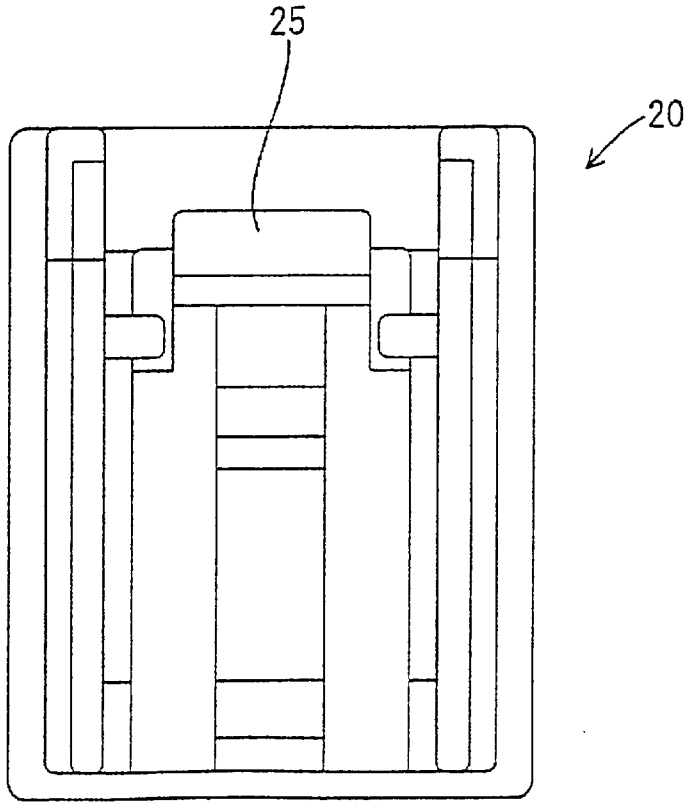
FIG. 2 is a plan view of the housing of FIG. 1.

Temporary locking protrusion strip 52 and final locking protrusion strip 53, as shown in FIG. 6, extend over the entire length of the outer surface of the ceiling wall plate 33 of the retainer 30 with the exception of the portion where ribs 50 are formed. On the other hand, locking groove 54, into which the above-mentioned temporary locking protrusion strip 52 and the final locking protrusion strip 53 can be fitted, is formed on the upper face of the upper retainer insertion hole 40, as shown in FIG. 1. Further, escape groove 55 which fits the temporary locking protrusion strip 52 and the final locking protrusion strip 53 is formed on both sides of locking groove 54.

Figure 8:
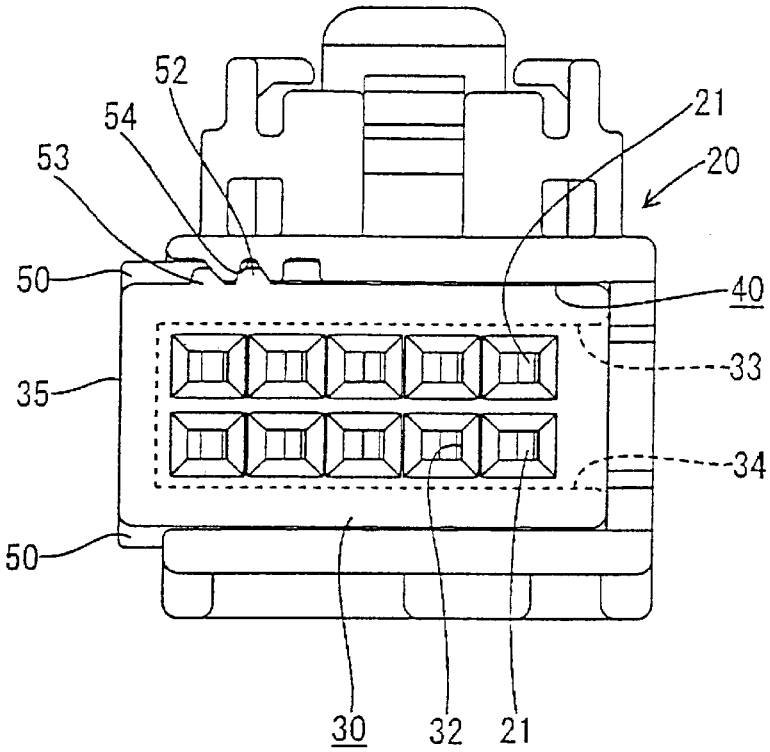
FIG. 8 is a front view of a housing with a retainer mounted in a temporary locked position.
Figure 12:
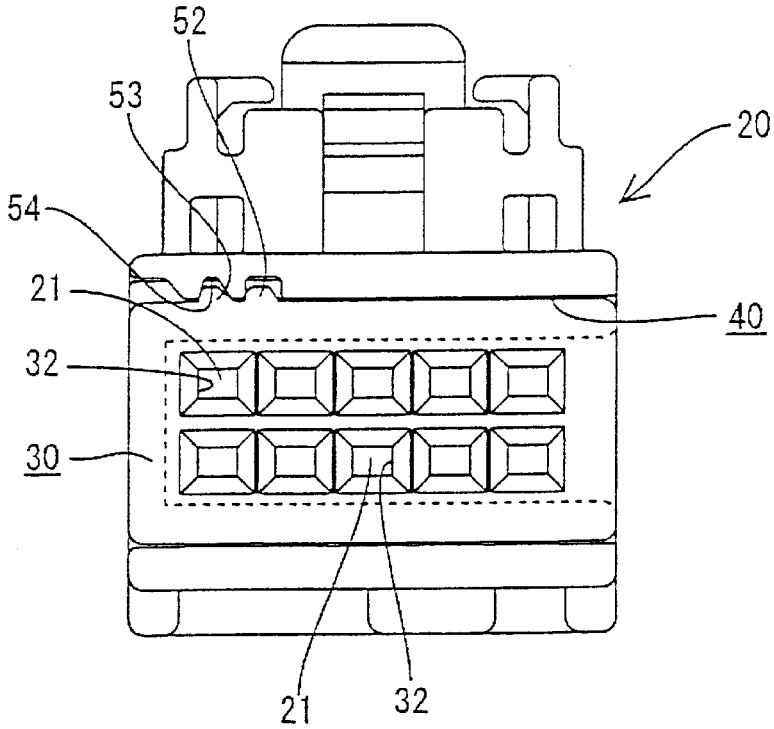
FIG. 12 is a front view of a housing with a retainer mounted in a final locked position.

As shown in FIG. 8, when the retainer 30 is inserted in the retainer insertion holes 40, the temporary locking protrusion strip 52 is fitted in the locking groove 54 to be retained in the temporary locking position of the retainer 30. Further, when the retainer 30 is pushed in from the temporary locking position to the final locking position, the final locking strip 53 is fitted in the locking groove 54 to be retained as shown in FIG. 12.

Figure 10:
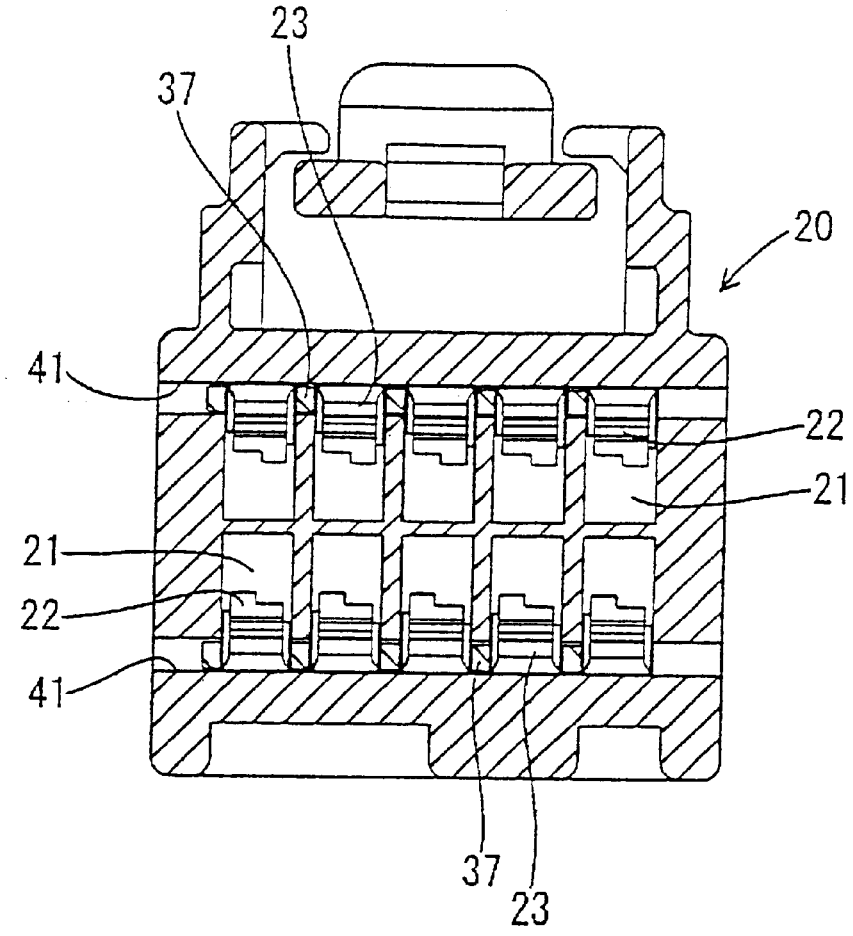
FIG. 10 is a sectional front view of the housing and retainer of FIG. 8.

When the retainer 30 is located at the temporary locking position, the side plate 35 protrudes from the side face of the housing 20. As shown in FIG. 10, each of the insert portions 37 is offset to the left side of the bending space 23 of the corresponding lances 22. Further, each of the projections 38 is likewise offset to the left side of the corresponding chambers 21.

Figure 13:
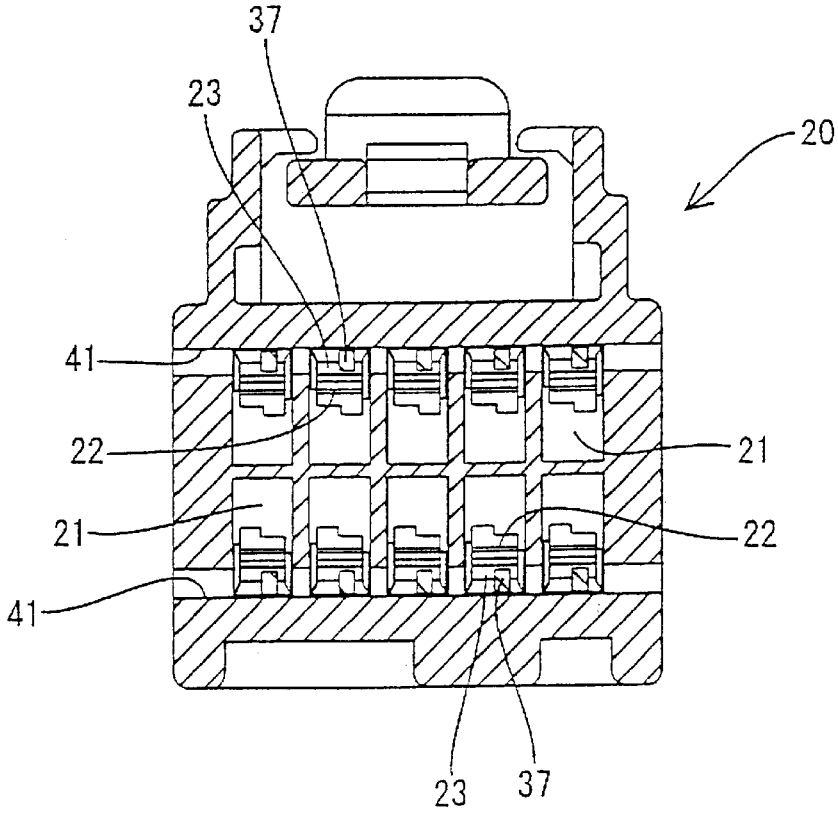
FIG. 13 is a sectional front view of the housing and retainer of FIG. 12.

When the retainer 30 is located at the final locking position, the side plate 35 is located in the concave part 43 in a condition coplanar with the side face of the housing 20. As shown in FIG. 13, each of the insert portions 37 penetrates into the bending space 23 of the corresponding lances 22. Further, each of the projections 38 likewise penetrates into the corresponding chambers 21.

Figure 9:
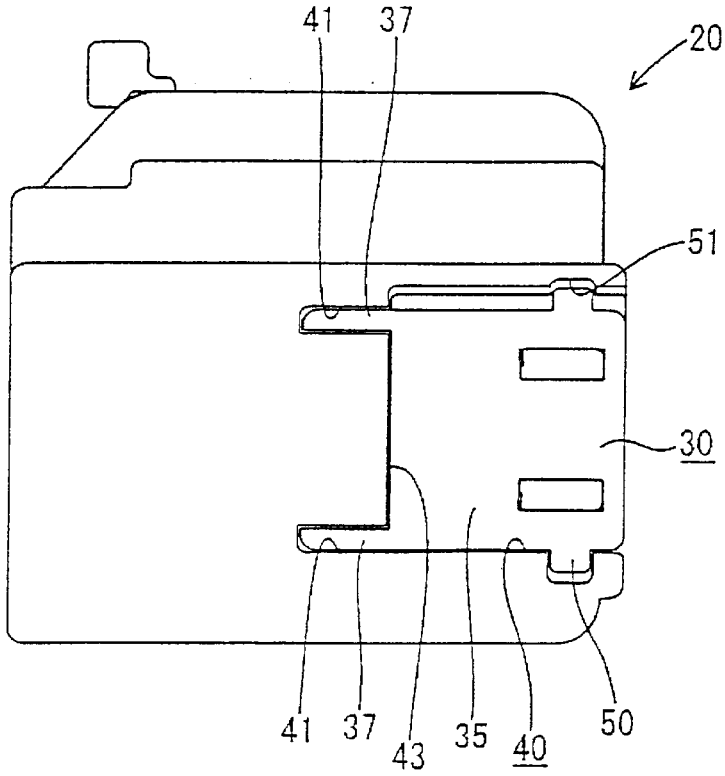
FIG. 9 is a side view of the housing and retainer of FIG. 8.
Figure 14:
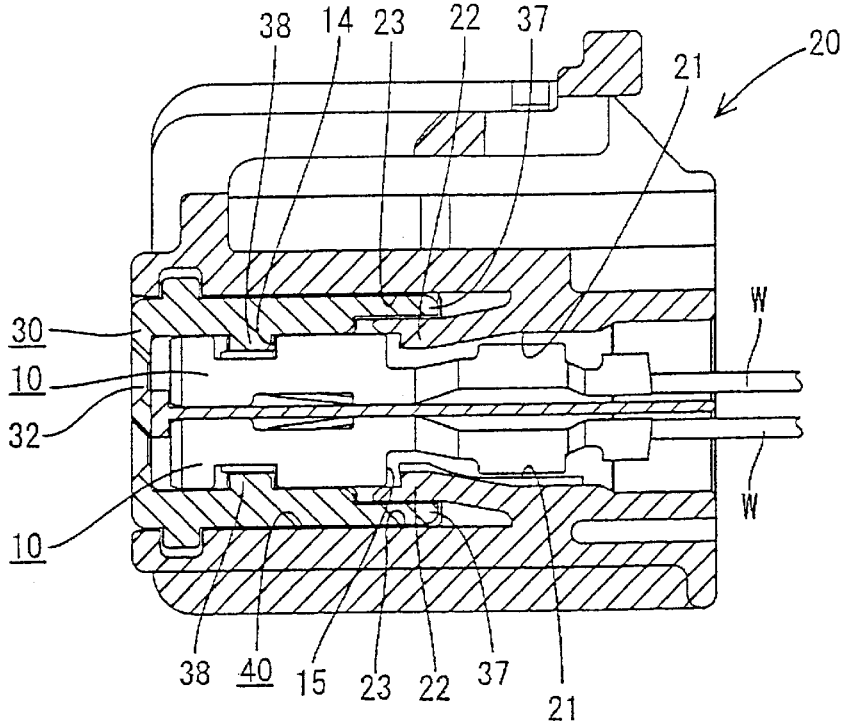
FIG. 14 is a sectional side view of the housing and retainer of FIG. 12.

The present mode of operation is described below. The retainer 30 is inserted in the retainer insertion holes 40 from the left side, and locked in the temporary locking position, as shown in FIGS. 8 and 9. As shown in FIG. 10, each of the insert portions 37 of the retainer 30 is offset to the left side of the bending space 23 of the corresponding lances 22. Further, each of the projections 38 is likewise offset to the left side of the corresponding chambers 21. The front stop plate 31 of the retainer 30 covers the front of the chambers 21 in a condition in which the terminal insertion openings 32 are offset. While the retainer 30 is in the temporary locking position, the female terminal fittings 10 are inserted in corresponding chambers 21 facing in opposite upper and lower positions, as shown in FIG. 11. The female terminal fittings 10 are pushed in while bending the lances 22 toward the bending space 23, and without being obstructed by the projections 38 of the retainer 30. When they are inserted in the proper position, the lances 22 return to their original positions, and are hooked on the barb portions 15, and temporarily locked in a no-slip condition as shown in FIG. 14.

When the insertion of the female terminal fittings 10 in the chambers 21 is complete, the retainer 30 is pushed to the final locking position as shown in FIG. 13. When the retainer 30 is moved to the final locking position, the projections 38 of the retainer 30 penetrate into the chambers 21, and are fitted in the hooked grooves 14 of the female terminal fittings 10 from the side. Further, the insert portions 37 of the retainer 30 enter into the bending space 23 of the lances 22 from the side, thereby locking the bending of the lances 22, and preventing the female side fittings 10 from being removed.

The female terminal fittings 10 are thereby doubly and triply locked in a non-removal condition by the retainer 30 in addition to the locking provided by lances 22.

Further, the terminal insertion openings 32 of the front stop plate 31 are placed in a condition in which they are concentrically aligned with the fronts of the respective chambers 21.

Figure 15:
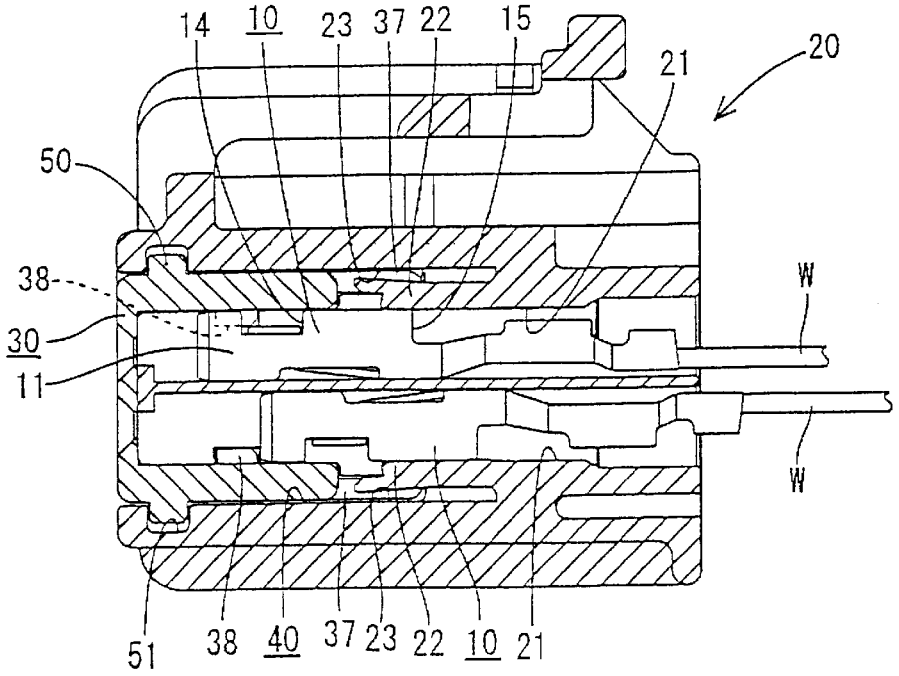
FIG. 15 is a sectional side view of a partially inserted female terminal fitting and detection thereof.

The female terminal fittings 10 may also be inserted in the chambers 21 in a partially inserted condition rather than the proper position. As shown in FIG. 15, the lances 22 remain in a condition in which they are bent into the bending space 23. When the retainer 30 is pushed in from the temporary locking position toward the final locking position, the insert portions 37 of the retainer 30 contact the side faces of the lances 22 located in the bending space 23. As shown in the upper level in FIG. 5, the projections 38 also contact the side face of the connecting parts 11 of the female terminal fittings 10. In this manner, the retainer is prevented from moving to the final locking position. Thus, partial insertion of the female terminal fittings 10 is detected.

When female terminal fittings 10 are partially inserted to an extent close to the proper insertion position, it may be difficult to visually detect the partial insertion condition. However, since detection takes place at two positions in the present embodiment, there is a higher level of assurance that detection will be properly carried out. Further, insert portions 37 contact a broad portion of the side faces of the lances 22, therefore the insertion into the bending spaces 23 is blocked with greater certainty than it is with insert portions inserted from a forward direction.

Further, the size and shape of lances 22 formed in a mold can be limited by the restricted opening area of the terminal insertion openings 32 provided in the front stop plate 31. However, since the front stop plate 31 is provided on the retainer 30 in the present embodiment, the front of the chambers 21 can be formed in easily releasable form during molding, and the degree of freedom in the design of the size and shape of the lances 22 can be increased.

According to the present mode of operation, the partial insertion of female terminal fittings 10 can be detected at two positions by hitting the projections 38 of the retainer 30 against the side face of the connecting parts 11 of the female terminal fittings 10, and by hitting the insert portions 37 against the lances 22 which are bent into the bending spaces 23. Therefore, the detection of the partial insertion condition can be more positively carried out.

Further, when the retainer is inserted in the final locking position, the projections 38 are fitted in the hooked grooves 14 for direct locking, and the insert portions 37 prevent the bending of the lances 22 for indirect locking. The female terminal fittings 10 are thus triply locked and therefore the female side terminal fittings 10 are firmly retained in a no-slip condition.

Further, the retainer can be formed in a compact manner. The hooked grooves 14 which are hooked on projections 38 of the retainer 30 are provided on the same level as the barb parts 15 on which lances 22 of housing 20 are hooked. This allows for projections 38 and the insert portions 37 to be provided close to one another in a compact manner.

Further, since the retainer 30 is transferred to a location for terminal insertion in a condition in which it is assembled at the temporary locking position, insertion of the female terminal fittings 10 into the chambers 21 can be conveniently carried out.

The present invention is not limited to the embodiment illustrated according to the above-mentioned description and drawings. For example, the following alternatives are also contemplated, and various other changes can be carried out within the scope of the present invention.

The front stop plate arranged in front of the chambers may be formed as a part of the housing, and the retainer may include only the hooking projections, the insert portions and supporting structure thereof.

The present invention can also be applied to a male connector which stores male terminal fittings.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present disclosure relates to subject matter contained in priority Japanese Application Nos. 2000-385614 and 2000-385623, both filed on Dec. 19, 2000, the disclosures of which are herein expressly incorporated by reference in their entireties.

What is claimed is:

1. A connector for accommodating terminal fittings having locking grooves and barb portions, said connector comprising:

a connector housing comprising:

chambers configured to receive terminal fittings inserted therein;

lances protruding into said chambers, said lances configured to bend into bending spaces outward of said chambers during insertion of terminal fittings, and to hook on barb portions of terminal fittings fully inserted in said chambers; and retainer insertion holes formed on a side face of said connector housing; and a retainer configured to be laterally inserted into said retainer insertion holes in a direction transverse to said chambers, said retainer comprising:

hooking projections configured to penetrate into locking grooves of terminal fittings fully inserted in said chambers; and insert portions configured to penetrate into bending spaces of said lances to prevent bending thereof.

2. The connector of claim 1, wherein said retainer is configured to be locked in a temporary locking position in which said hooking projections are laterally offset from said chambers and said insert portions are laterally offset from said bending spaces, to allow for insertion and extraction of the terminal fittings, and in a final locking position in which said hooking projections are inserted into said chambers and said insert portions are inserted into said bending spaces, to prevent insertion and extraction of the terminal fittings.

3. The connector of claim 1, wherein partial insertion of a terminal fitting is detected when lateral movement of said retainer is prevented by a hooking projection contacting a side portion of a terminal fitting and an insert portion contacting a side portion of a lance.

4. The connector of claim 3, wherein said retainer is configured to be locked in a temporary locking position in which said hooking projections are laterally offset from said chambers and said insert portions are laterally offset from said bending spaces, to allow for insertion and extraction of the terminal fittings, and in a final locking position in which said hooking projections are inserted into said chambers and said insert portions are inserted into said bending spaces, to prevent insertion and extraction of the terminal fittings.

5. The connector of claim 1, wherein said retainer further comprises a front stop plate configured to cover front openings of said chambers, said front stop plate having terminal insertion openings through which tabs of male terminal fittings can be inserted.

6. The connector of claim 5, wherein said retainer is configured to be locked in a temporary locking position in which said hooking projections are laterally offset from said chambers and said insert portions are laterally offset from said bending spaces, to allow for insertion and extraction of the terminal fittings, and in a final locking position in which said hooking projections are inserted into said chambers and said insert portions are inserted into said bending spaces, to prevent insertion and extraction of the terminal fittings.

7. A connector for accommodating terminal fittings having barb portions, said connector comprising:

a connector housing comprising:

chambers configured to receive terminal fittings inserted therein;

lances protruding into said chambers, said lances configured to bend into bending spaces outward of said chambers during insertion of terminal fittings, and to hook on barb portions of terminal fittings fully inserted in said chambers; and retainer insertion holes formed on a side face of said connector housing; and a retainer configured to be laterally inserted into said retainer insertion holes in a direction transverse to said chambers, said retainer comprising insert portions configured to penetrate into bending spaces of said lances to prevent bending thereof.

8. The connector of claim 7, wherein said retainer is configured to be locked in a temporary locking position in which said insert portions are laterally offset from said bending spaces, to allow for insertion and extraction of the terminal fittings, and in a final locking position in which said insert portions are inserted into said bending spaces, to prevent insertion and extraction of the terminal fittings.

9. The connector of claim 7, wherein partial insertion of a terminal fitting is detected when lateral movement of said retainer is prevented by an insert portion contacting a side portion of a lance.

10. The connector of claim 9, wherein said retainer is configured to be locked in a temporary locking position in which said insert portions are laterally offset from said bending spaces, to allow for insertion and extraction of the terminal fittings, and in a final locking position in which said insert portions are inserted into said bending spaces, to prevent insertion and extraction of the terminal fittings.

11. The connector of claim 7, wherein said retainer further comprises a front stop plate configured to cover front openings of said chambers, said front stop plate having terminal insertion openings through which tabs of male terminal fittings can be inserted.

12. The connector of claim 11, wherein said retainer is configured to be locked in a temporary locking position in which said insert portions are laterally offset from said bending spaces, to allow for insertion and extraction of the terminal fittings, and in a final locking position in which said insert portions are inserted into said bending spaces, to prevent insertion and extraction of the terminal fittings.

13. A connector for accommodating a terminal fitting having a locking groove and a barb portion, said connector comprising:

a connector housing comprising:

at least one chamber configured to receive a terminal fitting inserted therein;

at least one lance protruding into said chamber, said lance configured to bend into a bending space outward of said chamber during insertion of a terminal fitting, and to hook on a barb portion of a terminal fitting fully inserted in said chamber; and retainer insertion holes formed on a side face of said connector housing; and a retainer configured to be laterally inserted into said retainer insertion holes in a direction transverse to said chamber, said retainer comprising:

at least one hooking projection configured to penetrate into a locking groove of a terminal fitting fully inserted in said chamber; and at least one insert portion configured to penetrate into a bending space of said lance to prevent bending thereof.

14. The connector of claim 13, wherein partial insertion of a terminal fitting is detected when lateral movement of said retainer is prevented by a hooking projection contacting a side portion of a terminal fitting and an insert portion contacting a side portion of a lance.

15. The connector of claim 13, wherein said retainer further comprises a front stop plate configured to cover a front opening of said chamber, said front stop plate having a terminal insertion opening through which a tab of a male terminal fitting can be inserted.

16. The connector of claim 13, wherein said retainer is configured to be locked in a temporary locking position in which said hooking projection is laterally offset from said chamber and said insert portion is laterally offset from said bending space, to allow for insertion and extraction of the terminal fitting, and in a final locking position in which said hooking projection is inserted into said chamber and said insert portion is inserted into said bending space, to prevent insertion and extraction of the terminal fitting.

* * * * *